US008829343B1

(12) United States Patent
Thompson et al.

(10) Patent No.: US 8,829,343 B1
(45) Date of Patent: Sep. 9, 2014

(54) CABLE CONNECTOR SEAL KIT WITH TORQUE LIMITING SPACERS

(71) Applicants: Alvin Dean Thompson, St. Joseph, MO (US); Cecil Donald Comley, Kansas City, MO (US); John Jeffrey Comley, Liberty, MO (US); James Michael Comley, Liberty, MO (US)

(72) Inventors: Alvin Dean Thompson, St. Joseph, MO (US); Cecil Donald Comley, Kansas City, MO (US); John Jeffrey Comley, Liberty, MO (US); James Michael Comley, Liberty, MO (US)

(73) Assignee: DT Search and Designs, LLC, St. Joseph, MO (US)

( * ) Notice: Subject to any disclaimer, the term of this patent is extended or adjusted under 35 U.S.C. 154(b) by 129 days.

(21) Appl. No.: 13/627,002

(22) Filed: Sep. 26, 2012

Related U.S. Application Data

(60) Provisional application No. 61/539,214, filed on Sep. 26, 2011.

(51) Int. Cl.
*H01R 13/46* (2006.01)

(52) U.S. Cl.
USPC ..... 174/59; 439/409; 439/709; 174/60; 174/64

(58) Field of Classification Search
CPC ..... H02G 3/16; H02G 15/117
USPC ..... 174/59, 60, 64; 439/404, 409, 709
See application file for complete search history.

(56) References Cited

U.S. PATENT DOCUMENTS

| | | | | |
|---|---|---|---|---|
| 2,372,083 | A | 3/1945 | Johansson et al. | |
| 5,611,710 | A | 3/1997 | Essrich | |
| 5,641,312 | A | 6/1997 | Bippus et al. | |
| 6,113,421 | A | 9/2000 | Daoud | |
| 6,159,036 | A | 12/2000 | Daoud | |
| 6,350,144 | B1 | 2/2002 | Afflerbaugh et al. | |
| 6,608,255 | B1 | 8/2003 | Donner et al. | |
| 6,764,356 | B2 | 7/2004 | Becher et al. | |
| 6,780,044 | B1 | 8/2004 | Sawyer et al. | |
| 6,875,928 | B1 | 4/2005 | Hayes et al. | |
| 7,097,516 | B2 | 8/2006 | Werner et al. | |
| 7,238,063 | B2 | 7/2007 | Thompson | |
| 7,399,927 | B2 | 7/2008 | Glew | |
| 7,445,520 | B2 | 11/2008 | Thompson | |
| 7,465,879 | B2 | 12/2008 | Glew | |
| 7,625,248 | B2 | 12/2009 | Thompson | |
| 7,625,249 | B2 | 12/2009 | Thompson | |
| 7,628,659 | B2 | 12/2009 | Thompson | |
| 8,053,670 | B2 * | 11/2011 | Lin et al. | 174/59 |
| 8,212,145 | B2 * | 7/2012 | Nagai et al. | 174/59 |
| 8,263,880 | B2 * | 9/2012 | Kraus | 174/541 |

* cited by examiner

*Primary Examiner* — Dhirubhai R Patel
(74) *Attorney, Agent, or Firm* — Erickson Kernell Derusseau & Kleypas, LLC

(57) ABSTRACT

A seal kit with torque limiting spacers for use with a field communication cable connector having a housing containing a cable contact circuit board includes a plurality of seals and spacers. Inner and outer seals are provided. The inner seal is sized for reception in an inner channel of the cable connector housing. The outer seal, having a plurality of compressible ribs, is sized for reception in an outer channel in the cable connector housing. The spacers provide space between the cable contact circuit board and the cable connector housing. Each spacer has a bore for receiving a fastener therethrough. The spacers are sized in accordance with the size of the cable connector unit and the cable connected to the cable connector unit.

4 Claims, 7 Drawing Sheets

CABLE CONNECTOR SEAL KIT WITH TORQUE LIMITING SPACERS

CROSS-REFERENCE TO RELATED APPLICATIONS

This application claims the benefit of U.S. provisional patent application Ser. No. 61/539,214, filed Sep. 26, 2011, under 35 U.S.C. §119(e).

BACKGROUND

The present invention relates to a kit for use with field communication distribution equipment and, more particularly, to an improved cable connector seal kit that includes torque limiting spacers or stand offs.

The J-1077 A/U distribution box (hereinafter referred to simply as the "J-1077") is used to interconnect military field telephones and other communication devices in mobile, transportable, and semi-permanent installations. The J-1077 has provisions for connection of one or two 26 conductor-pair cables to a set of 26 pairs of spring post connectors mounted on a panel within the box. The standard cable for use with J-1077 type boxes is designated CX-4566 A/G. As such, the J-1077 can interconnect two 26-pair cables or can terminate a single 26-pair cable and provide connections to the conductors within the cable, such as for telephone sets or test equipment. The J-1077 has been in use for several decades and has proved to be generally rugged and reliable in varied field conditions. Additional information about the J-1077 distribution box can be obtained from Associated Industries of North Hollywood, Calif. (www.associated-ind.com) and from other sources.

The J-1077 distribution box and the standard CX-4566 A/G cable were originally designed for carrying multiple channels of audio frequency telephone signals. Military field communications have evolved beyond voice and teletype communications to high speed data communications for text, numeric, and image date in addition to voice signals. United States military services also make use of an expanded field distribution box or signal distribution panel designated as the J-2317 A/U box (referred to hereinafter simply as the J-2317 box) which has the interconnection capabilities of four J-1077 boxes. The conventional J-2317 box includes four 26-pair cable connectors, designated as connectors A, B, C, and D. Each cable connector terminates at a respective set of binding posts to enable patching of communications devices to 26-pair cables connected to the cable connectors.

A number of shortcomings for the J-1077 and J-2317 boxes have been remedied by the communication equipment disclosed in co-owned U.S. Pat. No. 7,238,063, U.S. Pat. No. 7,445,520, U.S. Pat. No. 7,625,248, U.S. Pat. No. 7,625,249, and U.S. Pat. No. 7,628,659; the entire contents of which patents are incorporated herein by reference.

In order to provide for digital communications between computers and computerized equipment, improved J-1077 type distribution boxes may have some of the insulation displacement connectors interconnected to connectors more appropriate for computer networks or for interconnections between modems. Such connectors can include, but are not limited to, RJ-45 (8P8C), RJ-11, and RJ-12 modular type connectors; BNC type connectors; and other connectors commonly employed for interconnections between computers. Conductors of the cables interconnecting the improved J-1077 boxes and carrying data between computers may be shielded separately from the other conductor pairs to minimize possible interference to and from other signals on other conductor pairs. Data connectors and associated cable conductors would provide some limited computer networking capabilities in addition to more conventional analog voice communications in systems employing J-1077 type distribution boxes. Alternatively, other types of connectors can be connected to selected insulation displacement connectors, such as standard phone connectors, F-type connectors, fiber optic adapters, and other standard types of network, telephone, audio, video, and signal connectors. The insulation displacement connectors and the auxiliary connectors are connected to a pair of box connectors positioned on opposite sides of the box to enable the distribution box to be connected to other boxes. The box connectors have sets of contacts which correspond to the conductors of the insulation displacement connectors and the auxiliary connectors.

A preferred type of box connector is designated U-187 A/G which is referred to as a side mount connector in which a side of the box connector structure is joined to the side wall of the box. It is foreseen that the box connector could alternatively be a U-186 C/G connector which is substantially similar to the U-187 A/G except that the U-186 C/G connector is joined to a side wall of the box by an end of the connector structure.

A preferred type of cable includes a plurality of pairs of cable conductors positioned within a conductive shield and an insulative tubular sheath. The cable may also include an outer "armor" layer which reduces damage from being chewed by animals and from other hazards. Each end of the cable includes a cable connector with a plurality of sets of contacts to which the cable conductors are connected. The cable connector is configured to be compatible with the configuration of the box connector. The conductor pairs, in cooperation with the cable connector, are configured to comply with Category 5E (Cat 5E) specifications. Cat 5E conductor pairs are typically twisted at a twist pitch of three twists per inch (2.54 cm). Preferably, the twist is maintained within the cable connector to within one-half inch (12.7 mm) of the contact terminal set to which the conductors are soldered. The conductor pairs and connector may be configured to specifications more stringent than Cat 5E.

Cable connectors with the military designation U-185 B/G and U-187 A/G are used to connect 26-pair Cat 3 and Cat 5E cables with each other and with the J-1077 or J-2317 box. Typically, both ends of the cables will have U-185 B/G connectors which are compatible with both the U-187 A/G and U-186 C/G box connectors. The U-185 B/G connector is a "genderless" type of connector and may be connected to another U-185 B/G connector to thereby connect one cable to another cable. The cable may also be provided at one end with another type of connector, such as a standard type of multi-contact cylindrical connector designated MS-27467 or AE167, often referred to as a barrel or Cannon connector.

The cable connectors are designed to provide a weatherproof encasement for a contact array board assembly having the standard military designation of MX-3227/G. The MX-3227/G includes a circuit board that enables electrical contact through the cable to the field communication box. The MX-3227/G is installed in each of the mating halves of a pair of cable connectors by fasteners that extend inboard from the outside surface of the connector. The connection posts on the inward-facing surfaces of the circuit boards are evenly sized, but the inner surfaces of the cable connector shells are stepped. When properly installed, the board fits flat within the rim of its respective cable connector shell, with one side floating over the stepped down portion of the shell. In the field, technicians install or replace the boards by inserting screw-type fasteners through the outside of the housing and into the connection posts without benefit of any torque specifications. This inevitably results in over tightening of the connector to the board on the floating side of the board, causing a crooked installation. When two misaligned connectors are matingly engaged, this leaves open contacts or connection points and causes the field communication device to malfunction.

The U-185/U-187 connector system was designed and built in the early 1960's to be rugged and reliable. In use, however, the connectors can rarely be fully closed and locked. Field personnel address this issue by forcing the mating parts together, which exerts pressure on the existing gaskets and on the MX-3227/G circuit boards when they are forced together. When the connector cannot be fully closed, the compressed gaskets will force the connectors apart, causing loss of a positive seal, allowing entry of moisture and dirt, and may result in intermittent or continuous interruption of circuit continuity between the cable and the box. This creates a perceived need for active line retorque of the fasteners on the MX-3227/G insert in order force the parts together, which may result in damage to the insert.

Over tightening and failure to achieve full connector closure thus result in misalignment of the MX-3227/G contact array boards and damage from excessive gasket pressure, which result in poor electrical connections between the cable and the box, which negatively affects the performance and reliability of the field data distribution system. Because the U-185 B/G and U-185 A/G cannot be locked in a fully closed position, these connectors are not fully utilized, which results in waste of the substantial cache of cables and equipment that utilize the U-185 B/G and/or U-185 A/G.

Thus there is a need for a cable connection system for 26 pair Cat 5E cables and field communication boxes that enables them to be connected in a fully closed and locked position with the MX-3227/G contacts properly aligned for full contact, and without excessive torque or damage to the MX-3227/G insert. In addition, there is a need for such a cable connection system that would enable the military to utilize its existing cache of cables and equipment that employ the U-185 B/G and/or U-185 A/G connectors.

SUMMARY

The present invention provides a greatly improved universal sealing solution kit with torque limiting standoffs or spacers for U-185 B/G and U-185 A/G connectors that allows for a full close of these connectors in a deployed situation without causing damage to the contact array board.

Embodiments of the present disclosure relate to a low torque outer gasket and compression inner gasket for providing stable gasket pressures within each connector interface and reducing the force required to obtain a fully closed and locked engagement of the connector parts. An array of torque limiting standoffs or spacers is sized for installation between the contact array board and the connector housing of the U-185 B/G and U-185 A/G to establish a predetermined position and pressure against the circuit boards so that all of the contact points will be aligned and engaged.

In one embodiment, the outer gasket includes a series of ribs

In one embodiment, the kit includes an array of torque limiting standoffs or spacers sized for respective use with the U-185 B/G and U-185 A/G connector housings with either Cat 3 or Cat 5E cables.

Various objects and advantages of the universal seal kit with torque limiting standoffs will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

DETAILED DESCRIPTION

Figure 1:
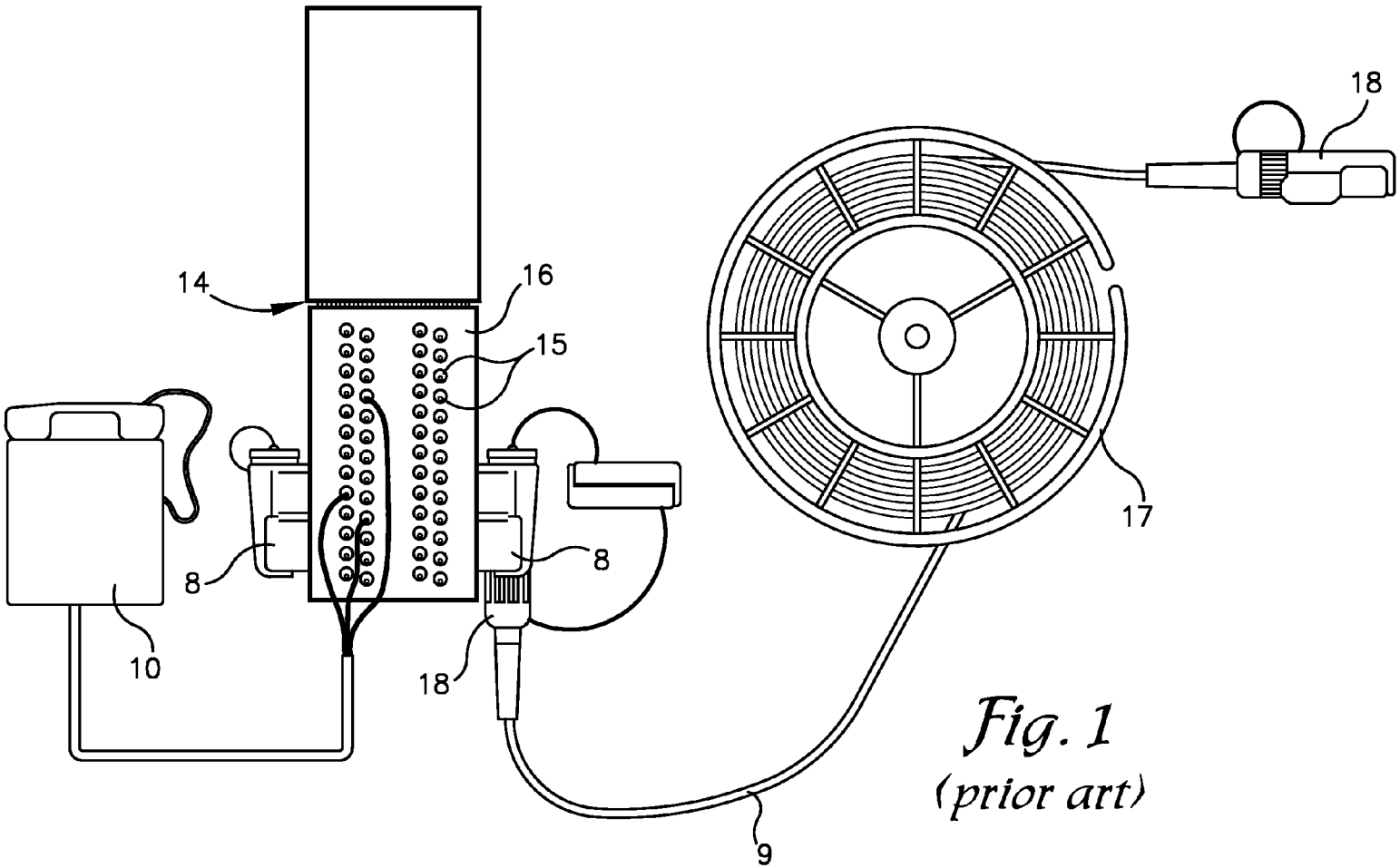
Fig. 1 (prior art)
FIG. 1 is a view of a J-1077 field communication box along with a cable reel and cable and a telephone set, with U-185 B/G connectors attached to each end of the cable and a U-187 A/G connector attached to the box.

As required, detailed embodiments of the universal seal kit with torque limiting standoffs are disclosed herein; however, it is to be understood that the disclosed embodiments are merely exemplary of the device, which may be embodied in various forms. Therefore, specific structural and functional details disclosed herein are not to be interpreted as limiting, but merely as a basis for the claims and as a representative basis for teaching one skilled in the art to variously employ the apparatus in virtually any appropriately detailed structure.

Referring now to the drawing figures, the reference numeral 1, (FIGS. 2 and 3) generally designates an improved field communication distribution box used in association with the present invention. The box 1 generally includes an access door or lid 2 hingedly connected thereto and a connector panel 3 positioned in the box 1 and having pairs 4 of insulation displacement connectors 5, test switches 6, and auxiliary connectors 7 mounted thereon. The box 1 has box connectors 8 mounted on sides thereof to enable connection of cables 9 to the connectors 5 and 7 thereof. Conversely, the connectors 5 and 7 enable connection of communication devices 10 to the cables 9 (FIG. 1) for communication with other devices 10 (FIG. 1) connected to the cables 9.

Referring to FIG. 1, the conventional field communication distribution box 14, with the military designation J-1077 A/U ("J-1077"), has a plurality of spring post connectors 15 mounted on a panel 16. The box 14 has the capability of interconnecting a pair of the cables 9 and provides for the connection of communication devices 10, such as telephone sets, to conductor pairs in the cables 9. FIG. 1 shows a cable reel 17 on which a cable 9 is stored and from which it is paid out from one box 14 to the next. The illustrated cable 9 (designated as CX-4566 A/G) has 26 numbered pairs of conductors and terminates at each end in a multi-terminal cable connector 18 (designated as a U-185 B/G connector). The cable connectors 18 mate with one of the box connectors 8 (designated U-187 A/G connectors) to interconnect two cables 9 and to enable connections of the devices 10 to the conductors of the cables 9.

Figure 2:
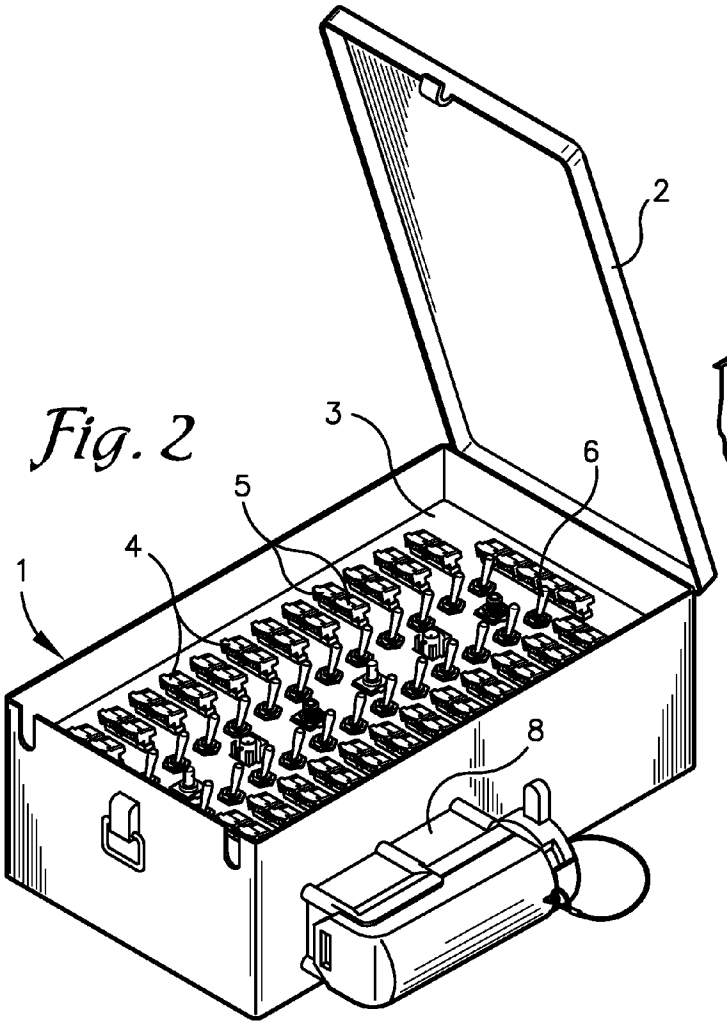
FIG. 2 is a perspective view of a J-1077 box modified with insulation displacement connector sets and test switches.
Figure 3:
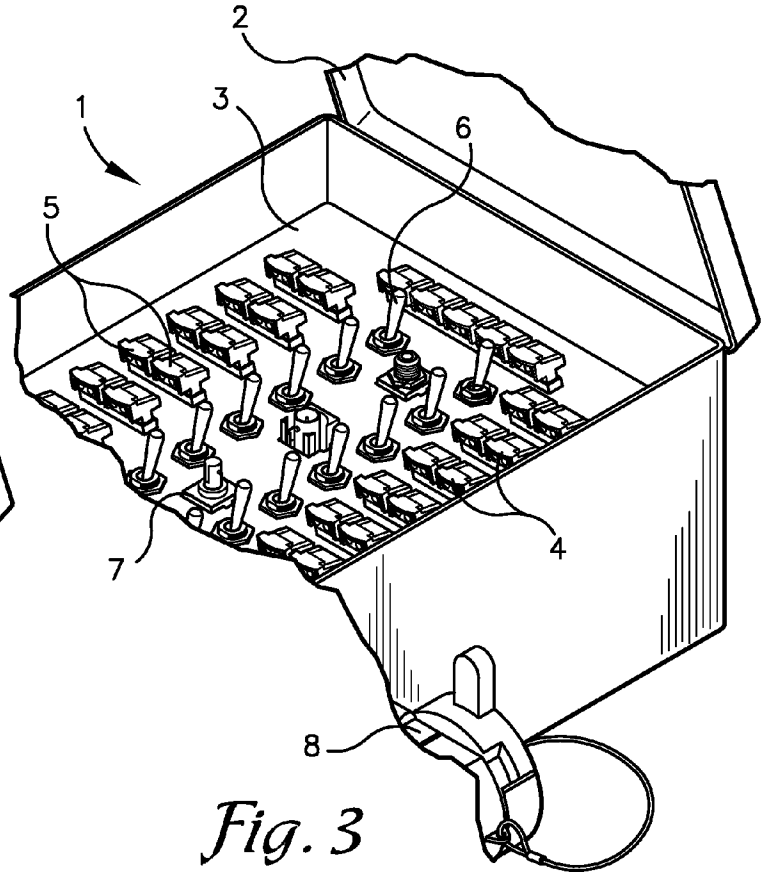
FIG. 3 is an enlarged fragmentary perspective view similar to FIG. 2 and illustrates elements of the modified J-1077 box in more detail.
Figure 4:
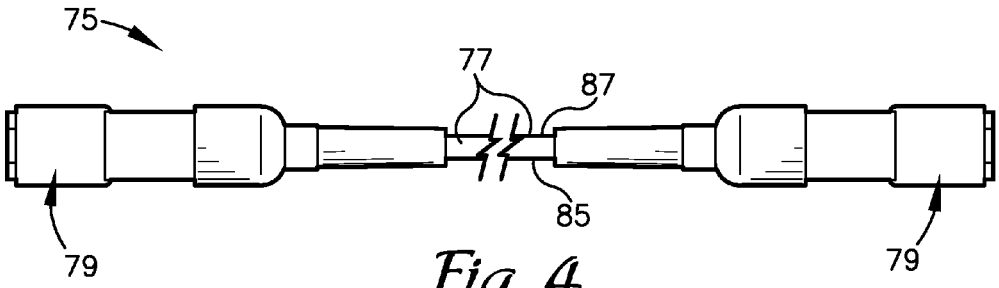
FIG. 4 is a fragmentary elevational view of an enhanced cable for a field data distribution according to the present disclosure.

Referring to FIG. 4, an enhanced cable assembly 75 is illustrated which is suitable for interconnecting field distribution boxes such as the enhanced distribution boxes 44, as well as the boxes 1 shown in FIG. 2. The enhanced cable assembly 75 is similar in many respects to the cable 9 of FIG. 1 which is a CX-4566 A/G cable, with differences which will be described. The illustrated cable assembly 75 includes a cable member 77 with cable connectors 79 positioned on opposite ends. The cable member or cable proper 77 includes a plurality of pairs 81 (FIG. 5) of insulated conductor members 83 which are enclosed within a conductive shield 85 and an outer insulative sheath 87. The cable member 77 may also include an outer "armor" layer (not shown) to reduce damage to the cable member 77 from contact with rough objects in the field, such as rocks, branches, exposed tree roots, and the like, being run over by vehicles, or being chewed by animals. The illustrated cable member 77 preferably includes 26 conductor pairs 81 which are twisted at a twist pitch of three twists per inch (2.54 cm).

Figure 7:
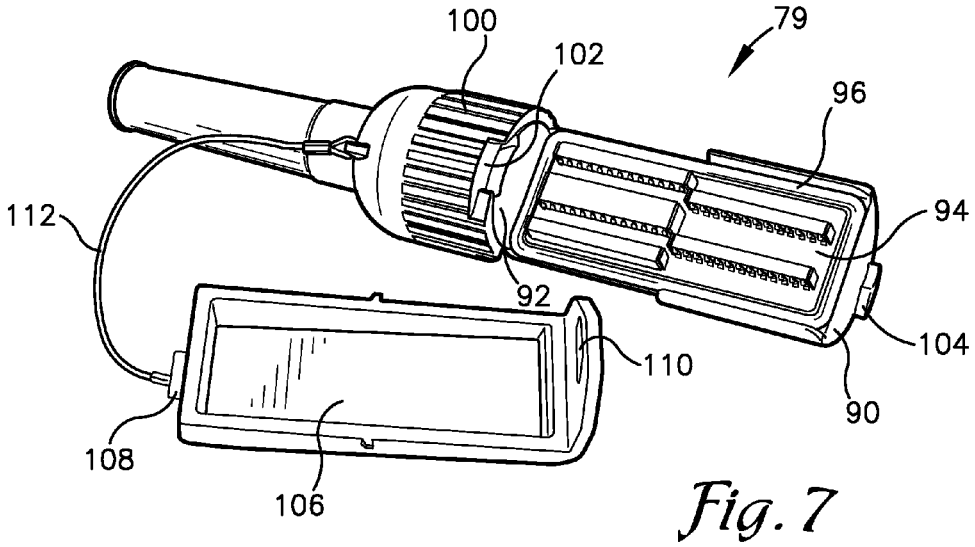
FIG. 7 is an enlarged perspective view of a U-185 B/G cable connector employed with a cable.

Referring to FIG. 7, the cable connector structure 79 includes a conductive shell 90 extending from a collar base 92 through which the cable member 77 extends. The shell 90 is connected to the shield 85 of the cable member 77. A contact array board assembly 94 is secured within the shell 90 and is surrounded by a resilient weather seal 96. The connector structure 79 includes a latch mechanism 98 to retain the connector 79 secured to a box connector 56 or 8 of a distribution box 44 or 1. In the illustrated connector 79, the latch mechanism 98 takes the form of a rotary or bayonet type of collar 100 surrounding the collar base 92 and having a notch 102 formed in an edge thereof. The outer end of the shell 90 is provided with a tab 104. The collar 100 and tab 104 cooperate with similar members on a box connector 56 whereby a tab of the box connector is received through the notch 102 and the tab 104 engages a notch of a collar of the box connector. The collar 100 and the box connector collar are rotated to retain the respective tabs of the cable connector 79 and the box connector 56. The latch mechanism 98 also allows two of the cable connectors 79 to be joined and retained in a joined condition in a similar manner. When the cable connector 79 is joined to a box connector 56 or another cable connector 79, the weather seals 96 thereof are mutually engaged to seal the respective connectors against the entry of moisture. The illustrated cable connector 79 includes a connector cover 106 including a tab 108 and a tab aperture 110 which respectively engage the notch 102 and tab 104 of the cable connector 79 for retention thereon. A lanyard 112 is typically provided to prevent the cover 106 from being misplaced.

Figure 5:
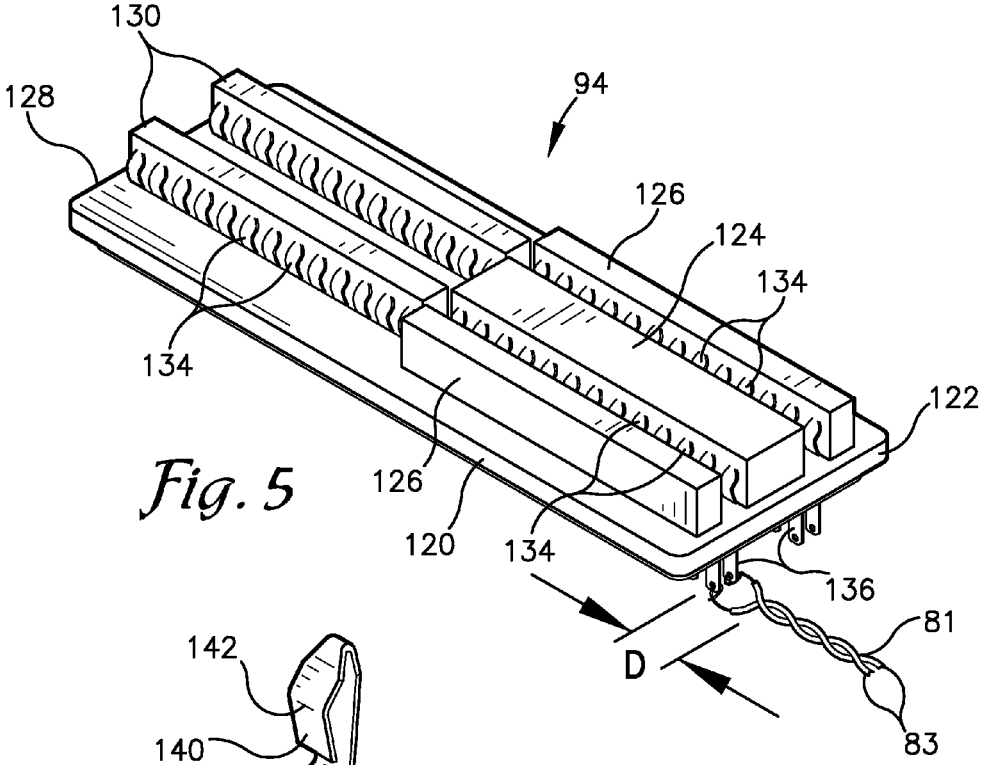
FIG. 5 is an enlarged perspective view of a contact array board assembly for use on the cable and on distribution boxes which the cable is employed to interconnect.
Figure 6:
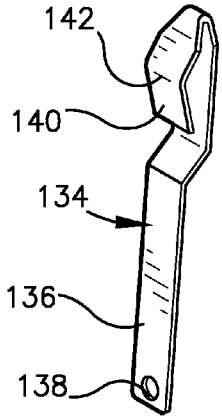
FIG. 6 is a greatly enlarged perspective view of a contact member of the contact assembly.

Referring to FIGS. 5 and 7, the contact array board assembly 94 includes a circuit board 120 with a plurality of contact support blocks positioned thereon. At an inner end 122 of the board 120, a wide center support block 124 is provided along with a pair of side support blocks 126. At an outer end 128 of the board 120, a pair of outer support blocks 130 is positioned on the assembly 94. The blocks 124, 126, and 130 are sized, shaped, and positioned so that the outer blocks 130 of one cable connector 79 or box connector 56 will fit within the spaces between the center block 124 and the side blocks 126 of another connector. The cable connectors 79 and box connectors 56 are, thus, genderless whereby any cable connector 79 can connect to a box connector 56 or another cable connector 79. The illustrated contact array board assembly 94 conforms to the specifications of the assembly having the standard designation of MX-3227/G. The illustrated cable connector 79 with the illustrated contact array board assembly 94 conforms to the type of standard cable connector designated as U-185 BIG.

The circuit board 120 and support blocks 124, 126, and 130 support a plurality of conductive contact members 134. Each contact member 134 includes a straight solder lug 136 with means such as an aperture 138 to receive a stripped end of a conductor 83 of a conductor pair 81. At an end opposite the aperture 138, a resilient contact pad 140 is formed. The illustrated contact pad 140 has a wide V-shaped ridge 142. When a cable connector 79 is joined with a box connector 56 or another cable connector 79, the ridges 142 of mutually engaging contacts 134 snap past one another to help retain the connectors together. The circuit board 120 is preferably a multi-layer circuit board with one or more internal ground plane layers (not shown) to form a shield in cooperation with the conductive shell 94. The solder lugs 136 of the contact members 134 extend through holes (not shown) in the circuit board 120 and are retained therein against the support blocks 124, 126, and 130. Each contact member 134 corresponds to a conductor 83. Each contact member 134 is replicated at opposite ends of the assembly 94 with internal traces (not shown) interconnecting the pairs of contacts 134. The patterns of contact members 134 at opposite ends of the contact array board assembly 94 are mirror images of one another so that when a cable connector 79 is connected to another cable connector or to a box connector 56, the signals are channeled to the correct conductor pairs 81.

The structure of the cable member 77 and the connectors 79 cooperate to enable the enhanced cable assembly 75 to comply with, or exceed, specifications of Category 5E ("Cat. 5E"), also known as Telecommunication Industry Association TIA/EIA-568-B standards. Cat. 5E incorporates the older Category 5 standards which enable cables to carry signals up to 100 MHz, including 100 Base-T and 1000 Base-T signals. Cat. 5E is enhanced from Category 5 with improved "far end" crosstalk performance.

In the illustrated enhanced cable assembly 75, the twist of the conductor pairs 81 is maintained within the cable connector 79 to within one half inch (12.7 mm) of their soldered connection to the solder lugs 136 of the contact members 134. This is illustrated as distance D in FIG. 5. This limitation in the untwisted portion of the conductor pairs 81 within the cable connector 79 improves the crosstalk performance of the cable assembly 75.

Figure 8:
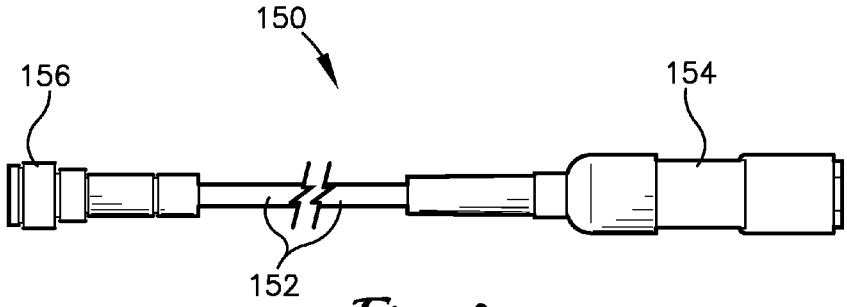
FIG. 8 is a view similar to FIG. 4 and illustrates a modified cable having a U-185B/G cable connector at one end and a standard type of multi-terminal cylindrical connector at an opposite end.

FIG. 8 illustrates a modified embodiment 150 of the enhanced cable assembly, including a cable member 152 similar to the cable member 77, a cable connector 154 similar to the cable connectors 79 at one end of the cable member 152, and a cylindrical connector 156 at an opposite end of the cable member. The cylindrical connector 156 may be a type of multi-conductor connector designated MS-27467, alternatively designated AE167. Such cylindrical connectors 156 are more compact than the cable connectors 154 for joining two cables 150 having properly gendered versions of the cylindrical connectors 156. The modified enhanced cable assembly 150 complies with, or exceeds, Cat. 5E specifications. In other respects, the cable assembly 150 is substantially similar to the enhanced cable assembly 75.

Figure 9:
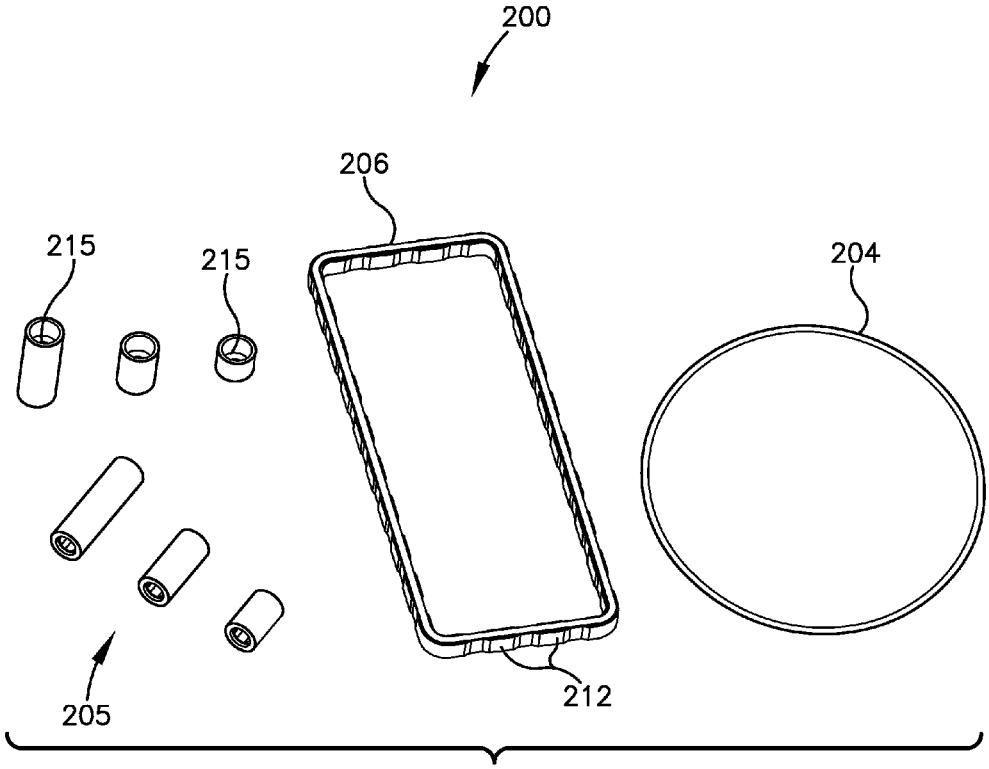
FIG. 9 is a perspective view of a seal kit with an array of sizes of torque limiting spacers used with U-185 B/G, U-187 A/G and Cat 3 and Cat 5E contact board assemblies and cables in accordance with the invention.
Figure 10:
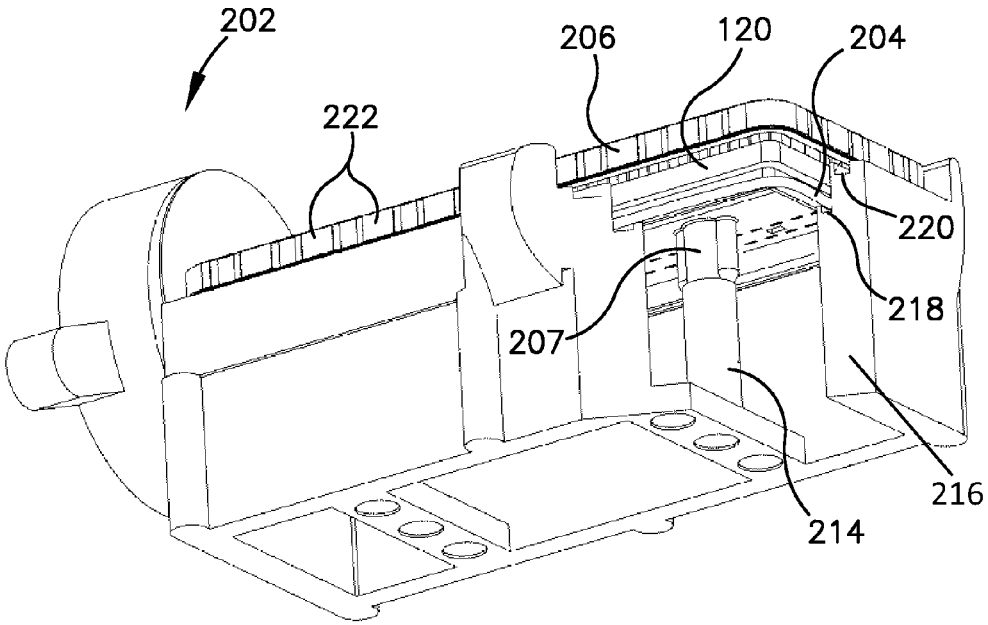
FIG. 10 is an enlarged perspective view of a U-187 A/G cable connector with parts broken away for clarity with one embodiment of a pair of seals and torque limiting standoff installed.
Figure 11:
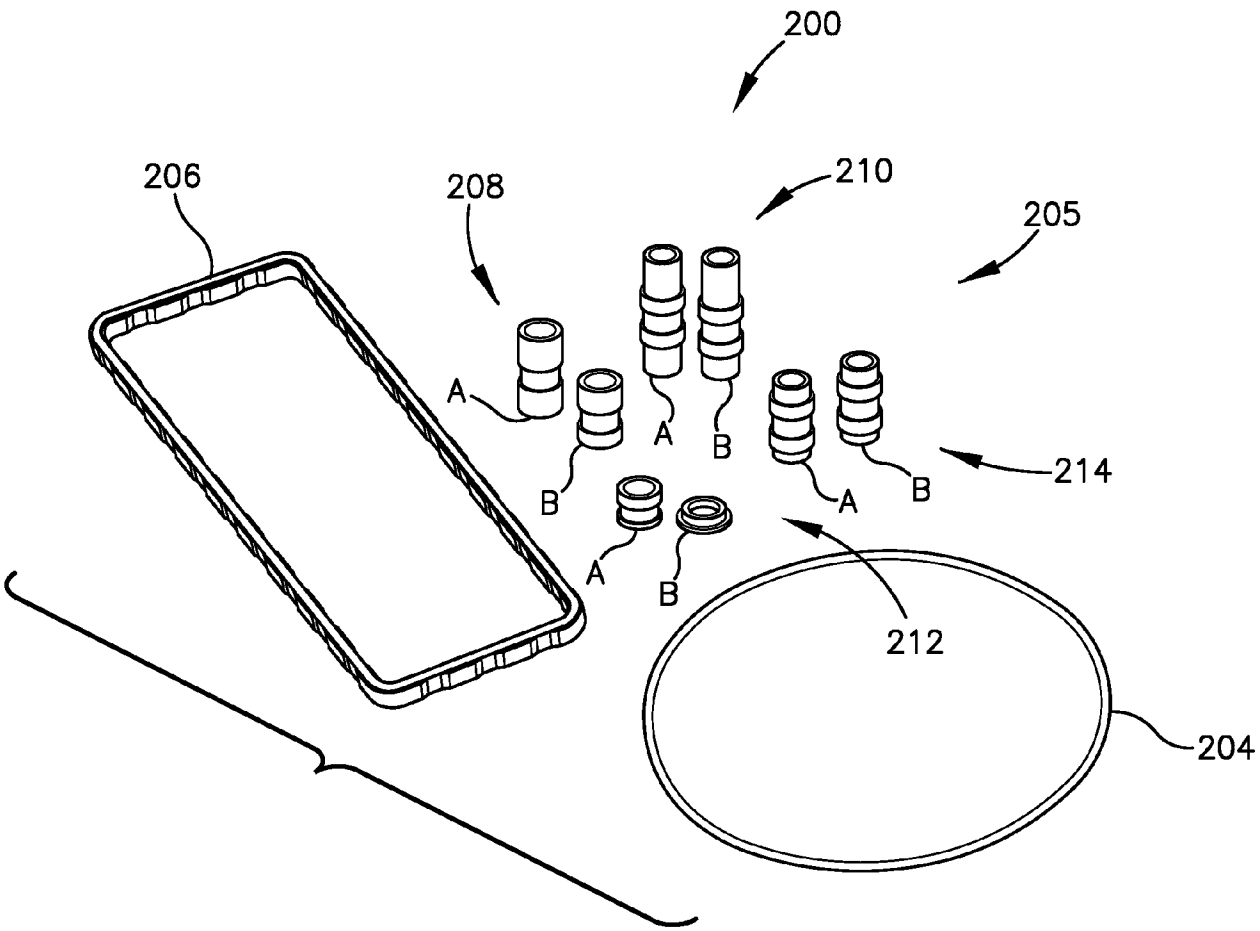
FIG. 11 is a perspective view of a seal kit with an array of pairs of torque limiting spacers in accordance with the invention.

An embodiment of a seal kit with torque limiting standoffs or spacers 200 is depicted in FIGS. 9 and 11 and is shown installed in a U-187A/G connector assembly 202 in FIG. 10. The kit includes an annular resilient inner seal or gasket 204, a generally rectangular outer resilient weather shield or gasket 206 and a set of standoffs or spacers 205 designed for use with any combination of the U-185 B/G and U-187 A/G cable connectors and contact array board assemblies 94 for either Cat 3 or Cat 5E cable. In one embodiment shown in FIG. 11, the set includes four pairs of spacers, 208*a* and 208*b*, which are sized and shaped for use with Cat 3 cable in the U-185 B/G connector, 210*a* and 210*b*, sized and shaped for use with Cat 3 cable in the U-185 A/G connector, 212*a* and 212*b* sized and shaped for use with Cat 5 cable in the U-185 B/G connector, and 214*a* and 214*b*, sized and shaped for use with Cat 5E cable in the U-185 A/G connector (FIG. 11). When used with the U-187 A/G connector, the spacers in each pair 210 and 214 are of the same size. When used with the U-185 B/G connector, the respective pairs 208 and 212 each include two differently sized connectors. FIG. 9 shows the six various sizes of connectors required to make up the pairs. While the kit 200 is particularly well adapted for use as a universal seal kit for the U-185 B/G and U-187 A/G military cable connectors and Cat 3 and Cat 5E cable and contact boards, it is foreseen that the kit may include seals 204 and 206 and spacers 205 that are sized for use with any type of available cable connector for any type of cable.

The bottom of the circuit board 122 of the MX 3227/G (FIG. 5) includes a pair of spaced apart, fixed threaded receivers 207 (FIG. 10) for engagement by a corresponding fastener. The standoffs 208-214 are each generally cylindrical in overall shape and are hollow or bored through to permit passage of a fastener therethrough to the receiver 207. The upper portion of each standoff bore has a diameter sized to receive a respective receiver 207 therein. The lower portion of each standoff bore has a diameter sized to receive a fastener therein. This difference in bore sizes forms an internal step 215, which serves as a limit or stop when the standoff is installed on a receiver 207. In this manner, the support 215 protects the circuit board 122 from damage when the standoffs are installed over the receivers 207. The standoffs may alternatively have a uniform inner diameter that is sized to accept the receiver 207 therein. It is also foreseen that the standoffs may be provided with an internal radial support flange positioned to serve as a stop. The standoffs for the various connectors may also be constructed to include color coded rings or the like (FIG. 11) to enable a technician to easily install properly sized standoffs on the respective connector assemblies and in accordance with the cable type.

As shown in FIG. 10, the U-187 A/G connector assembly is substantially similar to the U-185 B/G cable connector structure 79 shown in FIG. 7. The connector assembly 202 includes a shell 216, and a pair of inner and outer grooves or channels 218 and 220, arranged in stepped relation on the shell 216. The inner seal cooperates with the channel 218 to form a weather resistant, cushioned support surface for the circuit board 120 of the contact array board assembly 94. When the circuit board 120 is installed, the outer gasket 206 forms a sealable perimeter around the board 120.

The inner gasket 204 is preferably formed of low compression set silicone or other similar flexible, resilient and compressible material and is sized to fit around the perimeter margin of the circuit board 120 and to be received within the inner channel 218. The compressibility of the inner seal 204 holds the inner seal in place and eliminates the need to apply glue or other adhesive composition to the inside of the channel 218. Such an adhesive-free installation serves to insure that the seal 204 will not be forced upwardly, out of the channel 218 by application of excess adhesive.

The outer seal or gasket 206 is generally rectangular in overall shape and is sized and shaped to fit within the outer channel 220 in the connector assembly 202. The outer gasket 206 preferably includes a series of spaced ridges or ribs 222 that enhance the compressibility of the gasket 206.

In use, a technician selects an inner seal 204 from the seal kit 200 and fits it around the outer perimeter margin of the circuit board 120 of an MX-3227/G contact array board assembly 94. The technician selects an outer seal or gasket 206 and fits it onto the U-187 A/G shell 216, urging it into the outer channel 220. This provides a seal between the perimeter margin of the board 120 and the inner wall of the shell 216. The ribs 222 enable the gasket 206 to fit easily into the channel 220 with light compression.

The technician selects a pair of appropriate torque limiting spacers 208, 210, 212 or 214 from the array in the kit 200 in accordance with the type of connector to be sealed, e.g. U-185 B/G or U-187 A/G and cable type, e.g. Cat 3 or Cat 5E. The technician installs the spacers on the receiver posts 207 of the MX-3227/G contact 94 and urges the board assembly 94 into the shell 202 within the outer gasket until the inner seal 204 is received within the inner channel 218 as shown in FIG. 10. The MX-3227/G contact 94 is positioned within the outer gasket 206 within the U-185 A/G in similar fashion to the installation in the U-185 B/G connector shown in FIG. 7. Once this is accomplished, the technician inserts fasteners through the torque limiting spacers 214*a* and 214*b* and into the threaded receivers 207 to secure the MX-3227/G board in place in the connector assembly 202. The placement of the torque limiting spacers behind the MX-3227/G enables the contact array board insert 94 to "bottom out" against the inner surface of the connector which protects the insert 94 from over torque, which may pull the receivers 207 out of the board causing damage or breakage, and also insures that the insert 94 will be properly aligned within the connector.

When a cable connector 79, such as the U-185 B/G connector shown in FIG. 7 is equipped in this manner with seals and torque limiting spacers, and is joined with another cable connector 79 or with a box connector 202, such as the U-187 A/G connector shown in FIG. 10, the upper surfaces of the outer gaskets 206 are brought into sealing contact within their respective channels 220 to form a weatherproof connection.

In this manner, a kit 200 including the combination of inner and outer seals 204 and 206 and a variety of torque limiting standoffs 208, 210, 212 and 214, allows for a connector 79 and/or 202 to be sealed and fully closed and locked in position in deployed situations. The need for active line re-torque is greatly diminished. Damage to the MX3227 inserts is minimized because force on the MX-3227/G contact array board 94 is controlled. This serves to enhance the reliability, longevity, and capacity of the U185/U187 connectors.

It is to be understood that while certain forms of the cable connector seal kit with torque limiting spacers have been illustrated and described herein, it is not to be limited to the specific forms or arrangement of parts described and shown.

What is claimed is:

1. A kit for use with a field communication distribution cable assembly and a field communication distribution box including a plurality of sides and a box connector connected to one of the sides, the cable assembly including a plurality of conductors, a cable member having opposite ends, a cable connector having a plurality of sets of cable contact members positioned thereon and which are connected to one of the ends of the cable member with the plurality of conductors being connected to the cable contact members, the cable member connected to a conductive connector shell; and a cable contact circuit board secured to the connector shell and having sets of cable contact members positioned thereon, the board being of such a construction and cooperating with the connector shell in such a manner as to form an electrically shielded space within which the conductors are connected to the cable contact members; the kit comprising:

an inner seal, sized for reception in an inner channel of the connector shell;

an outer seal, sized for reception in an outer channel in the connector shell;

the outer seal having a plurality of compressible ribs extending in spaced relationship on inner and outer peripheries of the outer seal;

a plurality of pairs of spacer units for supporting the cable contact circuit board within the connector shell, each spacer unit having a bore for receiving a fastener therethrough; and each of the spacer units sized in accordance with a size of the cable contact circuit board and the cable connector.

2. The kit as in claim 1 wherein said outer seal is generally rectangular.

3. The kit as in claim 1 wherein said ribs are generally trapezoidal.

4. The kit as in claim 1 wherein each of the plurality of pairs of spacer units is sized and shaped for use with a different type of cable connector.

* * * * *